US005822964A

United States Patent [19]

Kerpays, Jr.

[11] Patent Number: 5,822,964

[45] Date of Patent: Oct. 20, 1998

[54] HOT-GAS ENGINE ELECTRIC HEATER

[76] Inventor: Rudy Kerpays, Jr., 19163 Jovan St., Reseda, Calif. 91335

[21] Appl. No.: 758,362

[22] Filed: Dec. 3, 1996

[51] Int. Cl.[6] ..... F01B 29/10

[52] U.S. Cl. ..... 60/523; 60/513

[58] Field of Search ..... 60/513, 523

[56] References Cited

U.S. PATENT DOCUMENTS

| | | | |
|---|---|---|---|
| 4,057,962 | 11/1977 | Belaire | 60/523 |
| 4,126,995 | 11/1978 | Asselman et al. | 60/524 |
| 4,715,183 | 12/1987 | Meijer et al. | 60/524 |
| 4,768,342 | 9/1988 | Darooka | 60/525 |
| 4,894,989 | 1/1990 | Mizuno et al. | 60/517 |

OTHER PUBLICATIONS

"STM Multi–Heat Engine" Advertisement from Stirling Thermal Motors, Inc.

*Primary Examiner*—Noah P. Kamen
*Attorney, Agent, or Firm*—Richard L. Miller, P.E.

[57] ABSTRACT

A hot-gas engine electric heater that is partially disposable in a heat exchange tube of a hot-gas engine and supplies heat to a working fluid in the hot-gas engine wherein the heat exchange tube has a contour. The heater includes a thin and circular-shaped base, at least one conically-shaped and outwardly tapering heating element, and a voltage regulator. The thin and circular-shaped base conforms to the contour of the heat exchange tube and has an outer surface and an inner surface that is conformingly and sealingly abuttable against the heat exchange tube and is disposable externally thereto. The at least one conically-shaped and outwardly tapering heating element is horizontally oriented and extends perpendicularly outwardly from the inner surface of the thin and circular-shaped base and receives a voltage for heating the working fluid and is enterable into the heat exchange tube so as to be non-protruding from the heat exchange tube and eliminate wasted heat. And, the voltage regulator is disposed on the outer surface of the thin and circular-shaped base and regulates the voltage received by the at least one conically-shaped and outwardly tapering heating element and is disposable externally to the heat exchange tube and receives a voltage.

16 Claims, 2 Drawing Sheets

HOT-GAS ENGINE ELECTRIC HEATER

BACKGROUND OF THE INVENTION

The present invention relates to a hot-gas engine electric heater. More particularly, the present invention relates to a hot-gas engine electric heater that is partially disposable in a heat exchange tube of a hot-gas engine and supplies heat to a working fluid in the hot-gas engine wherein the heat exchange tube has a contour. The heater includes a thin and circular-shaped base, at least one conically-shaped and outwardly tapering heating element, and a voltage regulator. The thin and circular-shaped base conforms to the contour of the heat exchange tube and has an outer surface and an inner surface that is conformingly and sealingly abuttable against the heat exchange tube and is disposable externally thereto. The at least one conically-shaped and outwardly tapering heating element is horizontally oriented and extends perpendicularly outwardly from the inner surface of the thin and circular-shaped base and receives a voltage for heating the working fluid and is enterable into the heat exchange tube so as to be non-protruding from the heat exchange tube and eliminate wasted heat. And, the voltage regulator is disposed on the outer surface of the thin and circular-shaped base and regulates the voltage received by the at least one conically-shaped and outwardly tapering heating element and is disposable externally to the heat exchange tube and receives a voltage.

The most common type of hot-gas engine is the Stirling engine which is an external-combustion engine that uses the closed Stirling cycle.

Stirling machines are energy conversion devices that operate over a closed, regenerative thermodynamic cycle. The single-phase working fluid is typically a gas such as helium or air.

Two configurations are commonly used. In one a piston varies the working gas volume and a displacer shuttles the gas within the machine, in the other configuration two pistons perform these tasks.

The gas is shuttled within the engine so that most of the gas is in the compression space when the piston compresses the gas, and most of the gas is in the expansion space when the piston allows the gas to expand.

If heat is supplied to the expansion space, then the Stirling machine acts as an engine, creating mechanical energy from thermal input. If the piston, however, is driven by supplied mechanical energy, then the Stirling machine acts as a cooler or heat pump.

The Stirling engine has pistons that move up and down in cylinders, uses a fixed volume of a working fluid that constantly back and forth between a hot top space and a cold bottom space in a cylinder, and relies on continuous external combustion of a fuel that supplies heat to the working fluid through the upper wall of a cylinder.

Stirling engines are often compared to internal combustion engines, since both have pistons that reciprocate. In many ways Stirling engines, however, are more similar to Rankine and closed-cycle Brayton machines, because the thermal source and sink are outside the metal walls that contain the working fluid. There are several advantages to isolating the thermal source from the thermodynamic cycle. Namely, a variety of heat sources can be utilized, such as concentrated solar energy, radioisotopes, combustion, etc. If combustion is utilized, it can occur in a steady-state process that can be efficient, low in atmospheric and thermal emissions, and quiet, and the closed cycle can use effective thermal regeneration which tends to increase efficiency.

Rotary Rankine and closed-cycle Brayton machines scale well to large sizes, but are less effective at lower power levels where the rotor tip clearance becomes significant compared to the turbine diameter, and blowby losses become relatively large. It is at these lower power levels, hundred of watts and less, where Stirling engines have a significant advantage in terms of conversion efficiency.

Stirling coolers are of interest because they can be efficient over a large operating temperature range and mechanically quite and simple compared to other low temperature refrigeration systems.

The potentially high performance is an attribute of the closed-cycle regenerative thermodynamic cycle.

The operating temperature range is large compared to vapor-compression type systems because phase change from vapor to liquid is not part of the Stirling cycle.

Stirling coolers typically use helium, which is gaseous above 4° K. Stirling coolers can achieve liquid nitrogen temperatures (77° K) in a single displacer/regenerator stage and 10° K in two to four cascaded displacer/regenerator stages. Another advantage is that the vibration at the cold end of the cooler can be quite low. The cold end can be isolated from the compressor portion of the machine through flexible tubing, and the displacer can be balanced, or replaced by a pulse tube scheme to achieve even lower vibration levels.

The theoretical efficiency of the Stirling engine is substantially higher than that of diesel and other internal-combustion engines.

Robert Stirling, a Scottish clergyman, patented an external-combustion engine in 1816. The first model was in use in 1818 for pumping water out of a quarry. This engine and later ones designed by him used air as the working fluid, and thus the Stirling engine also was called a hot-gas engine.

Thousands of small Stirling engines were used in industry in the 19th century, but they fell into disuse.

In the late 1930's the N. V. Philips company in Eindhoven, Netherlands, started research and development of engines working on the principle of the Stirling engine.

By the early 1970's there was keen interest in Philips Stirling engines because of their potential for reducing environmental pollution. These engines have low emission of harmful exhaust gases, a low noise level, a lower fuel consumption than that of gasoline engines, and no oil consumption. Also, a 4-cylinder double-acting Stirling engine runs as smoothly as a 16-cylinder gasoline engine. Philips has built a number of laboratory-model and prototype Stirling engines in sizes ranging from a few 10th's of a horsepower (hp) to 500 hp per cylinder.

The Stirling engine is expected to find growing use in special applications. It may be employed to haul ore in mines, where its nontoxic emission and low noise level would be valuable.

A Stirling engine using radioisotopes for its heat supply may be used to power an artificial heart.

In many respects the engine is technically able to replace gasoline and diesel engines. Thus, if its cost could be reduced sufficiently, it might even become widely used as a power plant in automobiles, trucks, and buses.

In operation the Stirling engine produces a surplus of work in the same way as the familiar gasoline or diesel engine does. The working fluid in a cylinder is compressed at a low temperature, heated rapidly, and then allowed to expand at a high temperature. A gasoline or diesel engine, however, is an internal-combustion engine, whereas a Stirling engine is an external-combustion engine.

In the internal-combustion engine, the rapid heating of the working gas (air) takes place by the combustion of fuel inside the cylinder. In contrast, however, the working gas of the Stirling engine obtains its heat by the combustion of a fuel outside the cylinder. The heat liberated by combustion is transmitted through the cylinder wall to the working gas. In this case, the working gas does not take part in the combustion. Consequently, the working gas does not need to be air but can be helium or some other gas chosen for optimum engine performance.

Numerous engine configurations for accomplishing the Stirling process have been designed. The most promising are the displacer system and the double-acting system.

In the displacer system, the rapid heating and subsequent cooling of the working gas take place by means of a two-piston system that makes the gas flow back and forth through two heat exchangers, respectively called a heater (constant high temperature) and a cooler (constant low temperature). To prevent wasteful loss of heat a third heat exchanger, called a regenerator, is inserted between the heater and the cooler.

The most progress has been made with a displacer system using a rhombic drive for two output shafts, one of which rotates clockwise and the other counterclockwise.

Stirling machines are classified by the type, arrangement and motion control of the moving components. The types of moving component include pistons, which have seals and cause volume and pressure changes as they move, and displacers, which transfer gas between the hot and cold sections of the machine without causing an overall volume change.

The alpha configuration features two pistons, each in its own cylinder. The beta configuration has a piston and a displacer in the same cylinder. The gamma configuration has a piston and a displacer, each in its own cylinder.

The double-acting configuration has multiple cylinders and elongated power pistons, and can be considered as coupled alpha engines, where the thermodynamic cycle takes place between the top of one piston and the bottom of the next piston. Liquid-piston engines can be considered to be of the alpha configuration.

The motions of the moving components can be controlled by connecting rods (kinematic) or the result of gas forces and spring/mass dynamics (free-piston). The Ringbom engine has a kinematic piston and a free-displacer. The Martini-Ringbom has a kinematic displacer and a free piston.

As shown in FIG. 1, which is a diagrammatic representation of a prior art typical Stirling engine utilizing a double acting system, the double-acting system 11, invented by Philips as early as 1942, contains a hot space (expansion space) 12 at the top 13 of each cylinder 14 and a cold space (compression space) 15 at the bottom 16 of each cylinder 14.

The hot space 12 of a cylinder is connected to the cold space 15 of an adjacent cylinder through a heat exchange tube 17, that contains a heater 18, a regenerator 19, and a cooler 20.

The pistons 21 in the cylinders 14 move with suitable phase shift between them. In the case of 4 cylinders, the shift is 90 degrees.

It now seems feasible to attain a double-acting engine with an engine weight per brake horsepower (bhp) that approaches that of the gasoline engine (four pounds per bhp).

Stirling engine technology has come a long way in the last 50 years. Highly efficient, durable engines have been demonstrated at several power levels. Improvements are still needed in several areas.

Engine designs tend to be based largely on rigorous computer codes. These codes attempt to model oscillating flows and non-steady heat transfer that is not well understood. The codes cannot be fundamentally verified, since it is not possible at present to make the high speed measurements necessary. Analysis improvements are steadily being made, which will lead to more optimized engine performance.

High efficiency, high power density engines use a pressurized working fluid. Effective seals are crucial, especially if helium or hydrogen are the working fluid. Mechanical seals have been used successfully, but may not be suitable for long life operation. Gas bearings/seals tend to reduce the efficiency of the engine, but may be the long-term solution.

The bulk of the cost for a mass-produced Stirling engine will be due to the heat exchangers, especially the regenerator. The cost is high because the suitable materials tend to be expensive and hard to machine, and because the heat exchanger designs tend to be intricate. Development of ceramic technology may be needed.

Numerous innovations for heat engines have been provided in the prior art that will be described. Even though these innovations may be suitable for the specific individual purposes to which they address, however, they differ from the present invention in that they do not teach hot-gas engine electric heater that is partially disposable in a heat exchange tube of a hot-gas engine and supplies heat to a working fluid in the hot-gas engine wherein the heat exchange tube has a contour. The heater includes a thin and circular-shaped base, at least one conically-shaped and outwardly tapering heating element, and a voltage regulator. The thin and circular-shaped base conforms to the contour of the heat exchange tube and has an outer surface and an inner surface that is conformingly and sealingly abuttable against the heat exchange tube and is disposable externally thereto. The at least one conically-shaped and outwardly tapering heating element is horizontally oriented and extends perpendicularly outwardly from the inner surface of the thin and circular-shaped base and receives a voltage for heating the working fluid and is enterable into the heat exchange tube so as to be non-protruding from the heat exchange tube and eliminate wasted heat. And, the voltage regulator is disposed on the outer surface of the thin and circular-shaped base and regulates the voltage received by the at least one conically-shaped and outwardly tapering heating element and is disposable externally to the heat exchange tube and receives a voltage.

FOR EXAMPLE, U.S. Pat. No. 4,126,995 to Asselman et al. teaches a hot-gas engine in which the transfer of heat from the heat-source to the meltable material of a heat storage reservoir is effected exclusively indirectly via the working medium in order to prevent overheating, fast corrosion, and cracking of the reservoir walls.

ANOTHER EXAMPLE, U.S. Pat. No. 4,715,183 to Meijer et al. teaches an external heating system for a heat engine such as a Stirling cycle engine which permits thermal energy to be provided by solar energy or fuel combustion sources. The system employs a complexly shaped heat pipe evaporator section having an enclosed cavity for receiving solar energy and another section forming hollow fins which is exposed to hot combustion gasses. Accordingly, either heat source may be used to evaporate working fluid within the heat pipe which is transferred to the associated heat engine.

STILL ANOTHER EXAMPLE, U.S. Pat. No. 4,768,342 to Darooka teaches a Stirling engine heater head that is constructed to provide an annular heat exchange region defined between a pressure vessel sidewall and the engine displacer cylinder. From an external manifold, through which a heated fluid flows, either heat exchange tubes are sealingly introduced into the heat exchange region. Thermal energy is thus transferred to the engine working fluid, while the heated fluid is maintained isolated from the vessel walls and the displacer cylinder. For a compound Stirling engine configuration, thermal energy is introduced from a common heated fluid manifold to the heat exchange regions of a pair of axially aligned Stirling engine modules via heat pipes or heat exchange tubes. This manifold may be sealingly joined with the pressure vessel to create a chamber which is pressurized to pressure balance the vessel walls.

YET ANOTHER EXAMPLE, U.S. Pat. No. 4,894,989 to Mizuna et al. teaches a heater for use with a Stirling engine and a method for heating a working fluid for a Stirling engine. The heater has a burner, heater tubes disposed in the burner, a space formed around the heater tubes which is filled with the heat-storing material, and a high-temperature heat source. The heat-storing material is sealed by a seal member. Heat produced by the high-temperature heat source is supplied to the heater tubes via the heat-storing material, hence the heat-storing material acts as a secondary heat source. Heat is stored in the heat-storing material in the form of sensible heat or latent heat, or a chemical reaction is employed.

FINALLY, STILL YET ANOTHER EXAMPLE, is the STM 4-120 Stirling Engine manufactured by Stirling Thermal Motors, inc., 275 Metty Drive, Ann Arbor, Mich. 48103 USA, Phone: (313) 995-1755, Fax: (313) 995-0610. The STM 4-120 Stirling Engine is the result of 15 years of Stirling engine development at Stirling Thermal Motors, Inc. (STM) in Ann Arbor, Mich., USA. This engine converts any form of heat of sufficient high temperature to either mechanical or electrical power.

The four cylinder, double acting STM 4-120 engine, is designed to meet industrial as well as automotive specifications. Double acting means that each piston acts as both power and displacer piston and there is only one piston in each cylinder.

This engine has demonstrated performance and fuel efficiency equivalent to a Diesel engine, with ultra-low emissions and up to 90% less noise than a Diesel engine.

The industrial version of the STM 4-120 engine is derated to operate at lower speed and temperature to assure a long service free life (60,000 hours). The automotive version operates at higher speed and temperature and is capable of producing up to 100 kW (134 hp).

The engine's environmentally friendly qualities has generated interest in manufacturing and marketing this engine for commercial applications. These qualities include multi-fuel capability, ultra-low exhaust emissions, low noise, vibration level, and long service free life.

The use of a variable swash plate changes the stroke, which in turn changes the power at constant working gas pressure, results in exceptional part-load performance where the maximum efficiency is maintained over a broad load range, fast transient response wherein the power changes from idle to full load in a ⅓ of a second, and compact design with constant thrust load on the swash plate, constant torque, and very low vibration.

The measured power output for the industrial version is 40 kW (40 hp) at 1800 rpm. The measured fuel to shaft efficiency is 36% using either natural gas or gasoline (including the efficiency of the complete combustion system). This shaft efficiency corresponds to a measured thermal efficiency of 42% which is based on the heat into the engine heater head (receiver) to shaft power.

The heat generated by solar energy using a concentrator is absorbed by the engine receiver inside the aperture. Thus, for solar applications, thermal efficiency will vary dependent upon the solar concentrator characteristics.

A higher concentration ratio, combined with an even flux pattern results in higher engine efficiency, and vice versa.

Compared to fossil fuel receivers, direct insulating solar receivers will have slightly lower thermal efficiency while sodium heat pipe receivers will have slightly higher efficiency.

Independent analysis projects STM 4-120 engine costs to be equal to a similar sized IC-engine (diesel or gasoline) in volume production. The STM 4-120 engine has fewer components and moving parts than an IC-engine of similar size.

The STM 4-120 engine can be used for a broad variety of applications by simply changing the receiver/heater head to use various heat sources such as combusting liquid, gaseous and biomass fuels or concentrated solar energy. This commonality results in a mass produced base engine with lower manufacturing costs.

STM Power Conversion Systems are 25 kWe generator sets operating on natural gas, LP gas, or diesel fuel. They provide environmentally friendly and socially accepted distributed electric power for urban or rural applications, off-grid or on-grid.

Technical Specifications of the STM 4–120 Stirling Engine

| | |
|---|---|
| Engine size (swept volume) | 0.48 liter |
| Rated Power Industrial Version | 30 kW/1800 rpm |
| Specific Power: | |
| Industrial Version | 60 kW/liter |
| Automotive Version | 200 kW/liter (268 hp/liter) |
| Weight | 124 kg (273 lbs) |
| Working Gas | Helium or Hydrogen |
| Working Gas | hermetically sealed within the cylinders by bellows |

It is apparent that numerous innovations for heat engines have been provided in the prior art that are adapted to be used. Furthermore, even though these innovations may be suitable for the specific individual purposes to which they address, however, they would not be suitable for the purposes of the present invention as heretofore described.

SUMMARY OF THE INVENTION

ACCORDINGLY, AN OBJECT of the present invention is to provide a hot-gas engine electric heater that avoids the disadvantages of the prior art.

ANOTHER OBJECT of the present invention is to provide a hot-gas engine electric heater that is simple and inexpensive to manufacture.

STILL ANOTHER OBJECT of the present invention is to provide a hot-gas engine electric heater that is simple to use.

YET ANOTHER OBJECT of the present invention is to provide a hot-gas engine electric heater that eliminates the need for liquid and gas fuels, solar power, nuclear power, dry fuel.

STILL YET ANOTHER OBJECT of the present invention is to provide a hot-gas engine electric heater that is non-polluting, such as from batteries, oil, gas, carbon dioxide, and conforms to the zero-emissions power plant mandate for 1998.

YET STILL ANOTHER OBJECT of the present invention is to provide a hot-gas engine electric heater that has unlimited use as a power plant.

STILL YET ANOTHER OBJECT of the present invention is to provide a hot-gas engine electric heater that can be retrofitted to existing hot-gas engines.

YET STILL ANOTHER OBJECT of the present invention is to provide a hot-gas engine electric heater that eliminates the need to charge batteries.

STILL YET ANOTHER OBJECT of the present invention is to provide a hot-gas engine electric heater that is energy efficient.

YET STILL ANOTHER OBJECT of the present invention is to provide a hot-gas engine electric heater that is partially disposable in a heat exchange tube of a hot-gas engine and supplies heat to a working fluid in the hot-gas engine wherein the heat exchange tube has a contour.

BRIEFLY STATED, STILL YET ANOTHER OBJECT of the present invention is to provide a hot-gas engine electric heater that includes a thin and circular-shaped base, at least one conically-shaped and outwardly tapering heating element, and a voltage regulator.

YET STILL ANOTHER OBJECT of the present invention is to provide a hot-gas engine electric heater wherein the thin and circular-shaped base conforms to the contour of the heat exchange tube and has an outer surface and an inner surface that is conformingly and sealingly abuttable against the heat exchange tube and is disposable externally thereto.

STILL YET ANOTHER OBJECT of the present invention is to provide a hot-gas engine electric heater wherein the at least one conically-shaped and outwardly tapering heating element that is horizontally oriented and extends perpendicularly outwardly from the inner surface of the thin and circular-shaped base and receives a voltage for heating the working fluid and is enterable into the heat exchange tube so as to be non-protruding from the heat exchange tube and eliminate wasted heat.

YET STILL ANOTHER OBJECT of the present invention is to provide a hot-gas engine electric heater wherein the voltage regulator is disposed on the outer surface of the thin and circular-shaped base and regulates the voltage received by the at least one conically-shaped and outwardly tapering heating element and is disposable externally to the heat exchange tube and receives a voltage.

STILL YET ANOTHER OBJECT of the present invention is to provide a hot-gas engine electric heater wherein each heating element of said at least one conically-shaped and outwardly tapering heating elements terminates in a hemispherically-shaped free end.

YET STILL ANOTHER OBJECT of the present invention is to provide a hot-gas engine electric heater that further includes a heat seal that is positionable between the thin and circular-shaped base and the heat exchange tube to compensate for irregularities in abutting surfaces.

STILL YET ANOTHER OBJECT of the present invention is to provide a hot-gas engine electric heater wherein the at least one conically-shaped and outwardly tapering heating element is at least two conically-shaped and outwardly tapering heating elements.

YET STILL ANOTHER OBJECT of the present invention is to provide a hot-gas engine electric heater wherein the at least two conically-shaped and outwardly tapering heating elements are vertically spaced apart and aligned along a diameter of the inner surface of the thin and circular-shaped base.

STILL YET ANOTHER OBJECT of the present invention is to provide a hot-gas engine electric heater that further includes a power supply for supplying the voltage to the voltage regulator and being disposable externally to the heat exchange tube.

YET STILL ANOTHER OBJECT of the present invention is to provide a hot-gas engine electric heater wherein the power supply is in electrical communication with the voltage regulator by an electrical connector.

STILL YET ANOTHER OBJECT of the present invention is to provide a hot-gas engine electric heater wherein the power supply is at least one of a generator and a battery.

YET STILL ANOTHER OBJECT of the present invention is to provide a method of heating a working fluid in a heat exchange tube of a hot-gas engine wherein the heat exchange tube has a contour.

STILL YET ANOTHER OBJECT of the present invention is to provide a method of heating a working fluid in a heat exchange tube of a hot-gas engine that includes the step of heating the working fluid by a hot-gas engine electric heater.

YET STILL ANOTHER OBJECT of the present invention is to provide a method of heating a working fluid in a heat exchange tube of a hot-gas engine wherein the hot-gas engine electric heater includes a thin and circular-shaped base, at least one conically-shaped and outwardly tapering heating element, and a voltage regulator.

STILL YET ANOTHER OBJECT of the present invention is to provide a method of heating a working fluid in a heat exchange tube of a hot-gas engine wherein the thin and circular-shaped base conforms to the contour of the heat exchange tube and has an outer surface and an inner surface that is conformingly and sealingly abuttable against the heat exchange tube and is disposable externally thereto.

YET STILL ANOTHER OBJECT of the present invention is to provide a method of heating a working fluid in a heat exchange tube of a hot-gas engine wherein the at least one conically-shaped and outwardly tapering heating element is horizontally oriented and extends perpendicularly outwardly from the inner surface of the thin and circular-shaped base and receives a voltage for heating the working fluid and is enterable into the heat exchange tube so as to be non-protruding from the heat exchange tube and eliminate wasted heat.

STILL YET ANOTHER OBJECT of the present invention is to provide a method of heating a working fluid in a heat exchange tube of a hot-gas engine wherein the voltage regulator is disposed on the outer surface of the thin and circular-shaped base and regulates the voltage received by the at least one conically-shaped and outwardly tapering heating element and is disposable externally to the heat exchange tube and receives a voltage.

YET STILL ANOTHER OBJECT of the present invention is to provide a method of heating a working fluid in a heat exchange tube of a hot-gas engine wherein each heating element of the at least one conically-shaped and outwardly tapering heating elements terminates in a hemispherically-shaped free end.

STILL YET ANOTHER OBJECT of the present invention is to provide a method of heating a working fluid in a heat exchange tube of a hot-gas engine that further includes a heat seal that is positionable between the thin and circular-shaped base and the heat exchange tube to compensate for irregularities in abutting surfaces.

YET STILL ANOTHER OBJECT of the present invention is to provide a method of heating a working fluid in a heat exchange tube of a hot-gas engine wherein the at least one conically-shaped and outwardly tapering heating element is at least two conically-shaped and outwardly tapering heating elements.

STILL YET ANOTHER OBJECT of the present invention is to provide a method of heating a working fluid in a heat exchange tube of a hot-gas engine wherein the at least two conically-shaped and outwardly tapering heating elements are vertically spaced apart and aligned along a diameter of the inner surface of the thin and circular-shaped base.

YET STILL ANOTHER OBJECT of the present invention is to provide a method of heating a working fluid in a heat exchange tube of a hot-gas engine that further includes a power supply for supplying the voltage to the voltage regulator and being disposable externally to the heat exchange tube.

STILL YET ANOTHER OBJECT of the present invention is to provide a method of heating a working fluid in a heat exchange tube of a hot-gas engine wherein the power supply is in electrical communication with the voltage regulator by an electrical connector.

YET STILL ANOTHER OBJECT of the present invention is to provide a method of heating a working fluid in a heat exchange tube of a hot-gas engine wherein the power supply is at least one of a generator and a battery.

The novel features which are considered characteristic of the present invention are set forth in the appended claims. The invention itself, however, both as to its construction and its method of operation, together with additional objects and advantages thereof, will be best understood from the following description of the specific embodiments when read and understood in connection with the accompanying drawing.

BRIEF DESCRIPTION OF THE DRAWING

The figures on the drawing are briefly described as follows.

LIST OF REFERENCE NUMERALS UTILIZED IN THE DRAWING

Figure 1:
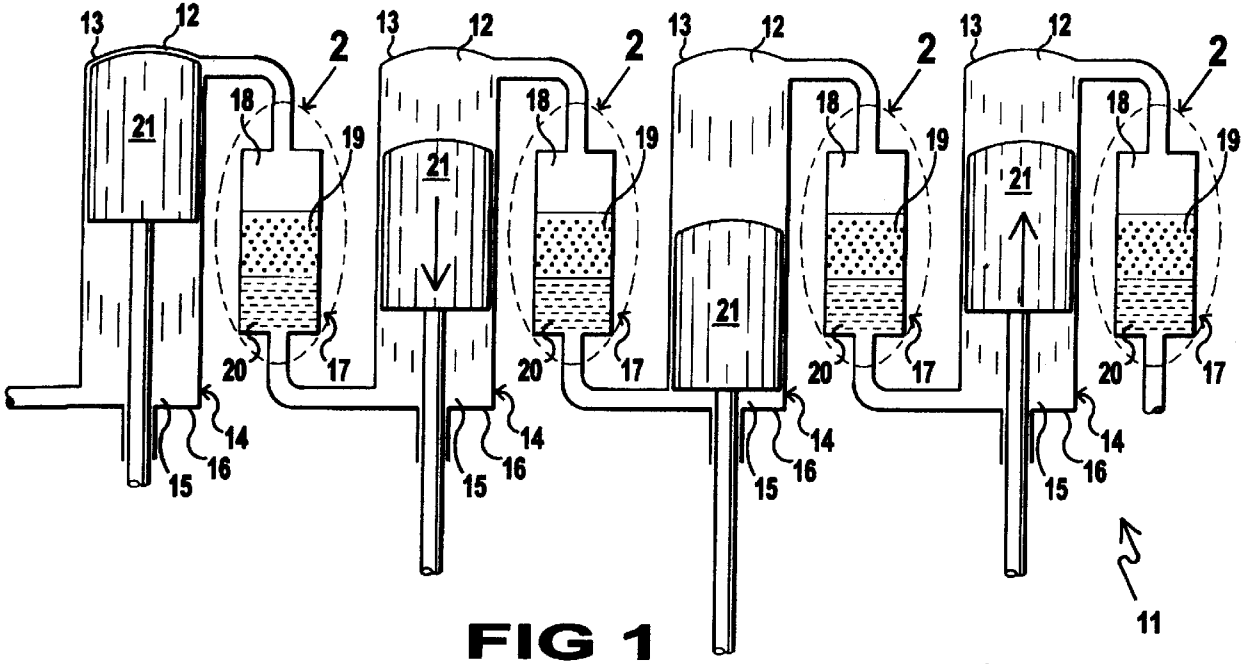
FIG 1 (PRIOR ART)
FIG. 1 is a diagrammatic representation of a prior art typical Stirling engine utilizing a double acting system.

| | |
|---|---|
| 11 | double-acting system |
| 12 | hot space (expansion space) in the top 13 of the cylinder 14 of the double-acting system 11 |
| 13 | top of the cylinder 14 of the double-acting system 11 |
| 14 | cylinder of the double-acting system 11 |
| 15 | cold space (compression space) in the bottom 16 of the cylinder 14 of the double-acting system 11 |
| 16 | bottom of the cylinder 14 of the double-acting system 11 |
| 17 | heat exchange tube of the double-acting system 11 |
| 18 | heater in the heat exchange tube 17 of the double-acting system 11 |
| 19 | regenerator in the heat exchange tube 17 of the double-acting system 11 |
| 20 | colloer in the heat exchnage tube 17 of the double-acting system 11 |

-continued

LIST OF REFERENCE NUMERALS UTILIZED IN THE DRAWING

| | |
|---|---|
| 21 | pistons in the cylinder 14 of the double-acting system 11 |
| 30 | hot-gas engine electric heater of the present invention |
| 32 | working fluid in the double-acting system 11 |
| 34 | thin and circular-shaped base of the hot-gas engine electric heater 30 |
| 36 | base outer surface of the thin and circular-shaped base 34 of the hot-gas engine electric heater 30 |
| 38 | base inner surface of the thin and circular-shaped base 34 of the hot-gas engine electric heater 30 |
| 40 | three conically-shaped and outwardly tapering heating elements of the hot-gas engine electric heater 30 |
| 41 | heating element hemispherically-shaped free end of each heating element of the three conically-shaped and outwardly tapering heating elements 40 of the hot-gas engine electric heater 30 |
| 42 | voltage regulator of the hot-gas engine electric heater 30 |
| 44 | power supply of the hot-gas engine electric heater 30 |

DETAILED DESCRIPTION OF THE PREFERRED EMBODIMENT

Figure 2:
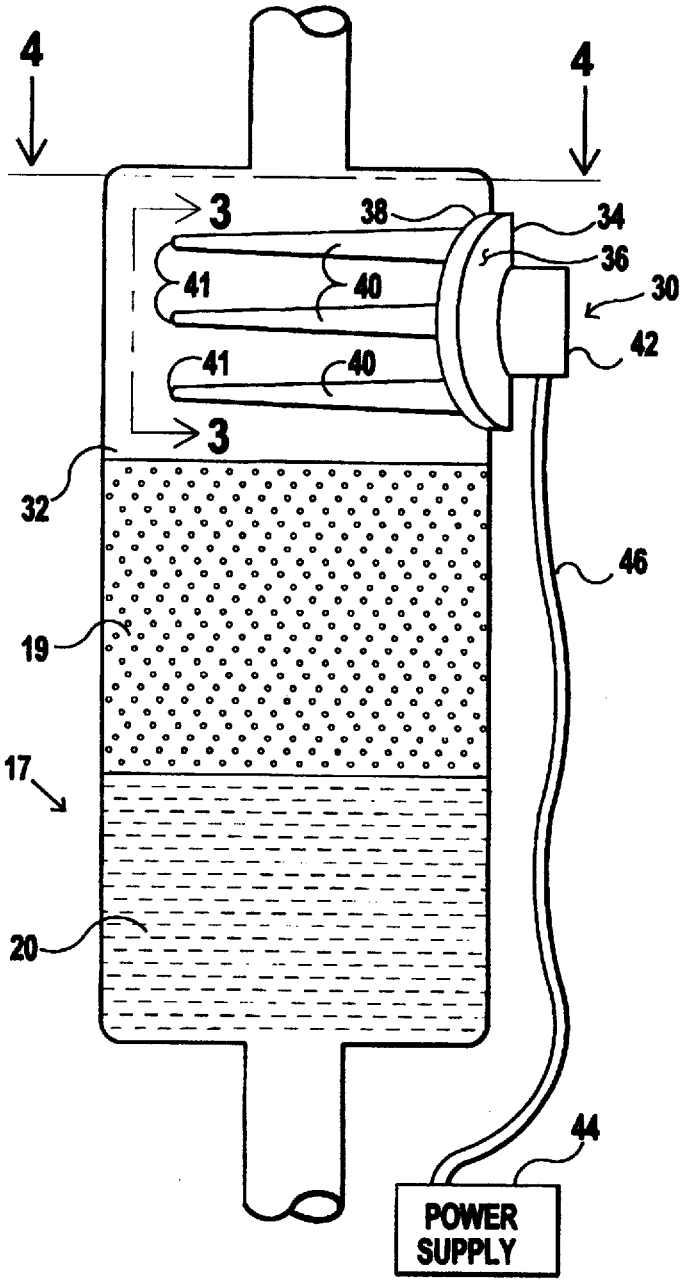
FIG. 2 is an enlarged diagrammatic representation of a heat exchange tube utilizing the present invention, which would be substituted in the area indicated by arrow 2 enclosed by the dotted ellipses in FIG. 1.

Referring now to the figures in which like numerals indicate like parts, and particularly to FIG. 2, which is a diagrammatic representation of a heat exchange tube utilizing the present invention, the hot-gas engine electric heater of the present invention is shown generally at 30 adapted to the heat exchange tube 17 with the regenerator 19 and the cooler 20 therein and heating a working fluid 32 therein.

Figure 4:
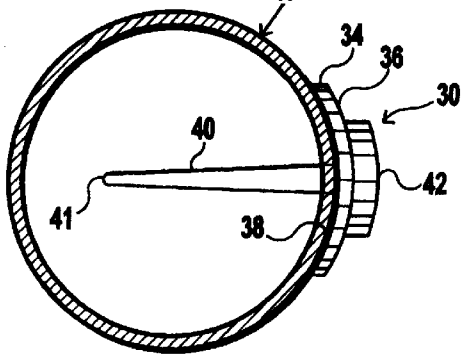
FIG. 4 is a diagrammatic cross sectional view, with parts broken away taken on line 4—4 of FIG. 2.
Figure 3:
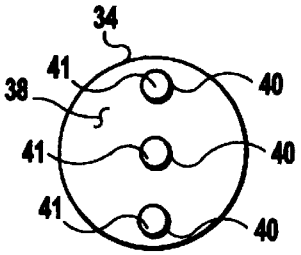
FIG. 3 is a diagrammatic side elevational view of the present invention taken on line 3—3 of FIG. 2.

The configuration of the hot-gas engine electric heater 30 can best be seen in FIGS. 2–4; which are an enlarged diagrammatic representation of a heat exchange tube utilizing the present invention, which would be substituted in the area indicated by arrow 2 enclosed by the dotted ellipses in FIG. 1; a diagrammatic side elevational view of the present invention taken on line 3—3 of FIG. 2; and a diagrammatic cross sectional view, with parts broken away taken on line 4—4 of FIG. 2; respectively, and as such will be discussed with reference thereto.

The hot-gas engine electric heater 30 includes a thin and circular-shaped base 34 that conforms to the contour of the heat exchange tube 17 and has a base outer surface 36 and a base inner surface 38 that is conformingly and sealingly abuttable against the heat exchange tube 17 and disposable externally thereto.

It is to be understood, however, that a heat seal may be provided between the thin and circular-shaped base 34 and the heat exchange tube 17, if necessary to compensate for irregularities in abutting surfaces.

The hot-gas engine electric heater 30 further includes three conically-shaped and outwardly tapering heating elements 40 that are horizontally oriented and vertically spaced apart and extend perpendicularly outwardly from the base inner surface 38 of the thin and circular-shaped base 34, aligned along a diameter thereof, and are enterable into the heat exchange tube 17 for heating the working fluid 32 therein so as to be non-protruding from the heat exchange tube 17 and eliminate wasted heat.

Each heating element of the three conically-shaped and outwardly tapering heating elements 40 terminates in a heating element hemispherically-shaped free end 41.

The significance of the configuration of the three conically-shaped and outwardly tapering heating elements 40 can best be understood from the discussion presented, infra.

Heat convection is the term applied to the heat transfer mechanism that occurs when a fluid of some known temperature flows past a solid surface at some different temperature. The flow of heat between the surface and the fluid is expressed in terms of the heat coefficient h.

The determination of the heat coefficient h necessitates the solution of the governing equations of a viscous, heat-conducting fluid. These equations in their general form, however, are not solvable analytically. The problem is simplified by the utilization of boundary layer theory.

In this simplified form, the fundamental equations to be solved near the body surface are expressed, infra, for an incompressible fluid:

Conservation of mass:

$$\frac{dv_x}{dx} + \frac{dv_y}{dy} = 0$$

Equation of motion:

$$v_x = \frac{dv_x}{dx} + v_y \frac{dv_x}{dy} = \frac{1}{\rho} \frac{dp}{dx} + \frac{1}{\rho} \frac{d\tau}{dy} + g\beta(T_f - T_\infty)$$

Conservation of energy:

$$v_x = \frac{dT_f}{dx} + v_y \frac{dT_f}{dy} = \frac{1}{\rho C_p}\left(\tau \frac{dv_x}{dy}\right) - \frac{1}{\rho C_p} \frac{d}{dy}\left(\frac{q}{A}\right)$$

wherein:

x=the coordinate measured parallel to the body surface y=the coordinate measured normal to x $v_x$=the fluid velocity in the direction of x $v_y$=the fluid velocity in the direction of y ρ=the fluid density p=the pressure $C_p$=the specific heat β=the coefficient of volume expansion $T_f$=the fluid temperature, to distinguish it from temperatures within the solid, and is generally a function of position within the fluid (i.e. a function of x and y)

τ=the shear stress within the fluid domain q/A=the heat flux within the fluid domain For laminar flow τ and q/A are expressed in terms of the gradients of velocity and temperature within the fluid by utilization of the hypothesized rate laws, infra:

$$\tau = \rho\nu \frac{dv_x}{dy}$$

$$\frac{q}{A} = -\rho C_p \alpha \frac{dT_f}{dy}$$

wherein:

v=the kinematic viscosity

α=the thermal diffusivity

In the instance when turbulent flow exists in the fluid, it is customary to augment these rate coefficients with their turbulent counterparts, the so-called eddy viscosity and eddy diffusivity.

In the equation of motion discussed, supra, the last term represents buoyant forces arising from temperature gradients in the fluid and may be absent in cases of pure forced convection. Likewise, in the conservation of energy equation discussed, supra, the first term on the right-hand side represents the rate of dissipation of kinetic energy into thermal energy through viscous action, and it may in certain cases be negligible.

In general, the solution to a particular convection problem consists of the simultaneous solution of the conservation of mass equation, the equation of motion, and the conservation of energy equation discussed, supra, under the appropriate boundary conditions, for the fluid temperature $T_f(x,y)$. The heat transfer coefficient is then determined by utilization of Fourier's law at the surface:

$$h = \frac{k\left(\frac{dT_f}{dy}\right)_s}{(T_f - T_\infty)}$$

wherein: s=the surface

Usually, the solutions referred to, supra, are expressed in dimensionless form. If the conservation of mass equation, the equation of motion, the conservation of energy equation, the rate law equations, and the Fourier's law at the surface equation discussed, supra, are nondimensionized by introducing a characteristic velocity U and a characteristic dimension L, the dependance implied, supra, of h on the other parameters may be expressed as:

$$N_{NU} = f_n(N_{RE}, N_{GR}, N_{EC}, N_{PR})$$

In the equation, supra, the quantities shown are dimensionless groupings of variables that bear the following designations:

Nusselt number:

$$N_{NU} = h\frac{L}{k}$$

Reynolds number:

$$N_{RE} = U\frac{L}{\nu}$$

Grashoff number:

$$N_{GR} = \frac{L^3 g\beta(T_s - T_\infty)}{\nu^2}$$

Eckert number:

$$N_{EC} = \frac{U^2}{C_p(T_s - T_\infty)}$$

Prandtl number:

$$N_{PR} = \frac{\nu}{\alpha}$$

Thus it is apparent that convection is a function of surface geometries and hydrodynamic boundary conditions. The region in which the velocity and temperature of the fluid changes occur in the boundary layer. Because velocity and temperature gradients both approach zero at the outer edge of the boundary layer, there is no heat flow out of the boundary layer by conduction or convection.

An accounting of all of the energy streams entering and leaving a small volume in the boundary layer during steady-state conditions yield:

$$\kappa\left(\frac{d^2t}{dx^2}+\frac{d^2t}{dy^2}\right)=wc_p\left(u\frac{dt}{dx}+v\frac{dt}{dy}\right)$$

wherein:

κ=the thermal conductivity of the fluid w=the weight density of the fluid $c_p$=the specific heat at constant pressure of the fluid u=the velocity component of the fluid in the x direction v=the velocity component of the fluid in the y direction The equation, supra, states that the net energy conducted into the element equals the increase in energy of the fluid leaving (convected) over what it had entering.

At the surface, u=v=0 and $d^2t/dx^2=dt/dx=0$. Thus, $\kappa(d^2t/dy^2)=0$, and the equation, infra, is obtained:

$$\kappa\frac{dt}{dy}=\text{constant}=\frac{q}{A}$$

wherein:

q=the time rate of flow through an infinitesimally thin layer dx

A=the cross-sectional area normal to the direction of flow

The equation, supra, shows that the heat transfer in the immediate vicinity of the surface is accomplished by conduction through a thin layer of the fluid which does not move relative to the surface. At a very small distance from the surface, however, the velocity becomes finite and some of the energy conducted normal to the surface is convected parallel to it. This process causes the temperature gradient to decrease, eventually to zero. The solution of a problem requires determination of the temperature distribution throughout the boundary layer. From this, the temperature gradient at the surface and the rate of heat flow can be computed.

The effect of energy leaving a surface and remaining in the boundary layer is a gradual increase in temperature of the fluid in the layer as it moves therealong, and a diffusion of energy further from the surface entraining more of the fluid in, and thickening, the boundary layer.

Thus, it is apparent from the discussion, supra, that to maximize heat transfer, the boundary layer on the surface must be maximized while boundary layer separation from the surface must be minimized. The use of the three conically-shaped heating elements accomplish this.

The use of a circular-shaped cross section for each heating element of the three conically-shaped and outwardly tapering heating elements 40 maximizes boundary layer size while it minimizes boundary layer separation.

The use of three conically-shaped and outwardly tapering heating elements 40 being horizontally oriented and vertically spaced apart and aligned along a diameter of the base inner surface 38 of the thin and circular-shaped base 34, allows the working fluid 32 heated by one heating element of the three conically-shaped and outwardly tapering heating elements 40 to be further heated by the next highest heating element of the three conically-shaped and outwardly tapering heating elements 40, as a result of the isotherms flowing vertically and outwardly from the surface.

The conical shape of each heating element of the three conically-shaped and outwardly tapering heating elements 40 and the hemispherical shape of the heating element hemispherically-shaped free end 41 of each heating element of the three conically-shaped and outwardly tapering heating elements 40 reduces impedance to the flow of the working fluid 32 therepast so that turbulent flow is minimized and laminar flow is maximized which further contributes to maximizing boundary layer and minimizing boundary layer separation.

The choice for using three heating elements of the three conically-shaped and outwardly tapering heating elements 40 is based on the fact that in general, when an electric current i flows, heat $H_{dissipated}$ is dissipated in all conducting elements owing to their ohmic resistance. If the combined resistance of these is r, the Joulean heat production in time dτ is given by:

$$ri^2d\tau=ri\frac{dz}{d\tau}\,d\tau=ridz$$

Since i may be taken as a constant, the heat dissipated $H_{dissipated}$ for a given charge z passed therefore varies with r. Thus, it can be seen that the use of the three heating elements of the three conically-shaped and outwardly tapering heating elements 40 is an ample number to maximize heat transfer by increasing the amount of resistance while the spaces therebetween do not impede isotherm development and flow between adjacent heating elements of the three heating elements of the three conically-shaped and outwardly tapering heating elements 40.

It is therefore apparent from the discussion, supra, that the configuration of the three heating elements of the three conically-shaped and outwardly tapering heating elements 40 is not merely a matter of design choice but is significant and of critical importance. It therefore must be considered in determining patentability, as was decided in In re Dailey et al., 149 USPQ 47 (CCPA 1976), where the Court held that the shape of a device must be considered in determining patentability, if the shape is significant:

" . . . the configuration of the container is a 'mere matter of choice' not significantly novel . . . , [since] . . . Appellants have provided no argument which convinces us that the particular configuration of their container is significant . . . " [Emphasis added]

The hot-gas engine electric heater 30 further includes a voltage regulator 42 disposed on the base outer surface 36 of the thin and circular-shaped base 34 and regulates the voltage supplied to the three conically-shaped and outwardly tapering heating elements 40, and is disposable externally to the heat exchange tube 17.

The hot-gas engine electric heater 30 further includes a power supply 44 that is in electrical communication with the voltage regulator 42, by an electrical connector 46, and supplies voltage to the voltage regulator 42, and is disposable externally to the heat exchange tube 17.

It is to be understood that the power supply 44 may be a generator, a battery, or a combination thereof that may be switched back and forth, if so desired.

It will be understood that each of the elements described above, or two or more together, may also find a useful application in other types of constructions differing from the types described above.

While the invention has been illustrated and described as embodied in a hot-gas engine electric heater, it is not limited to the details shown, since it will be understood that various omissions, modifications, substitutions and changes in the forms and details of the device illustrated and its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute characteristics of the generic or specific aspects of this invention.

The invention claimed is:

1. A hot-gas engine electric heater partially disposable in a heat exchange tube of a hot-gas engine and supplying heat to a working fluid in the hot-gas engine, wherein the heat exchange tube has a contour, comprising:

a) a thin and circular-shaped base conforming to the contour of the heat exchange tube and having an outer surface and an inner surface being conformingly and sealingly abuttable against the heat exchange tube and disposable externally thereto;

b) at least one conically-shaped and outwardly tapering heating element being horizontally oriented and extending perpendicularly outwardly from said inner surface of said thin and circular-shaped base and receiving a voltage for heating the working fluid and being enterable into the heat exchange tube so as to be non-protruding from the heat exchange tube and eliminating wasted heat; and c) a voltage regulator disposed on said outer surface of said thin and circular-shaped base and regulating the voltage received by said at least one conically-shaped and outwardly tapering heating element and being disposable externally to the heat exchange tube and receiving a voltage.

2. The heater as defined in claim 1, wherein each heating element of said at least one conically-shaped and outwardly tapering heating elements terminates in a hemispherically-shaped free end.

3. The heater as defined in claim 1; further comprising a heat seal positionable between said thin and circular-shaped base and the heat exchange tube to compensate for irregularities in abutting surfaces.

4. The heater as defined in claim 1, wherein said at least one conically-shaped and outwardly tapering heating element is at least two conically-shaped and outwardly tapering heating elements.

5. The heater as defined in claim 4, wherein said at least two conically-shaped and outwardly tapering heating elements are vertically spaced apart and aligned along a diameter of said inner surface of said thin and circular-shaped base.

6. The heater as defined in claim 1, further comprising a power supply for supplying the voltage to said voltage regulator and being disposable externally to the heat exchange tube.

7. The heater as defined in claim 6, wherein said power supply is in electrical communication with said voltage regulator by an electrical connector.

8. The heater as defined in claim 6, wherein said power supply is at least one of a generator and a battery.

9. A method of heating a working fluid in a heat exchange tube of a hot-gas engine wherein the heat exchange tube has a contour, comprising the step of heating the working fluid by a hot-gas engine electric heater which comprises:

a) a thin and circular-shaped base conforming to the contour of the heat exchange tube and having an outer surface and an inner surface being conformingly and sealingly abuttable against the heat exchange tube and disposable externally thereto;

b) at least one conically-shaped and outwardly tapering heating element being horizontally oriented and extending perpendicularly outwardly from said inner surface of said thin and circular-shaped base and receiving a voltage for heating the working fluid and being enterable into the heat exchange tube so as to be non-protruding from the heat exchange tube and eliminating wasted heat; and c) a voltage regulator disposed on said outer surface of said thin and circular-shaped base and regulating the voltage received by said at least one conically-shaped and outwardly tapering heating element and being disposable externally to the heat exchange tube and receiving a voltage.

10. The method as defined in claim 9, wherein each heating element of said at least one conically-shaped and outwardly tapering heating elements terminates in a hemispherically-shaped free end.

11. The method as defined in claim 9; further comprising a heat seal positionable between said thin and circular-shaped base and the heat exchange tube to compensate for irregularities in abutting surfaces.

12. The method as defined in claim 9, wherein said at least one conically-shaped and outwardly tapering heating element is at least two conically-shaped and outwardly tapering heating elements.

13. The method as defined in claim 12, wherein said at least two conically-shaped and outwardly tapering heating elements are vertically spaced apart and aligned along a diameter of said inner surface of said thin and circular-shaped base.

14. The method as defined in claim 9; further comprising a power supply for supplying the voltage to said voltage regulator and being disposable externally to the heat exchange tube.

15. The method as defined in claim 14, wherein said power supply is in electrical communication with said voltage regulator by an electrical connector.

16. The method as defined in claim 14, wherein said power supply is at least one of a generator and a battery.

* * * * *